US006129502A

United States Patent [19]

Marcelli

[11] Patent Number: 6,129,502

[45] Date of Patent: Oct. 10, 2000

[54] DEVICE FOR THE TRANSFER OF A LOAD BY THRUST AND TRACTION IN THE SAME PLANE

[76] Inventor: Pierre Marcelli, 10 rue des Lilas - F, 25660 Laveze, France

[21] Appl. No.: 09/171,072

[22] PCT Filed: Apr. 11, 1997

[86] PCT No.: PCT/FR97/00645

§ 371 Date: Oct. 9, 1998

§ 102(e) Date: Oct. 9, 1998

[87] PCT Pub. No.: WO97/38934

PCT Pub. Date: Oct. 23, 1997

[30] Foreign Application Priority Data

Apr. 12, 1996 [FR] France ..... 96 04770

[51] Int. Cl.[7] ..... B66F 9/00

[52] U.S. Cl. ..... 414/661; 74/89.21; 74/110

[58] Field of Search ..... 414/661, 280, 414/659, 400, 395; 901/749; 198/468.9, 748; 74/89.21, 110

[56] References Cited

U.S. PATENT DOCUMENTS

| | | | |
|---|---|---|---|
| 2,619,241 | 11/1952 | Jessen | 414/661 |
| 2,672,249 | 3/1954 | Ulinski | 414/661 |
| 2,818,189 | 12/1957 | Schreck . | |
| 2,832,487 | 4/1958 | Oster et al. | 414/661 |
| 3,598,265 | 8/1971 | Aaronson | 414/661 |
| 3,885,692 | 5/1975 | Anderson, Jr. | 214/514 |
| 4,217,074 | 8/1980 | Leasor et al. | 414/661 |
| 4,268,210 | 5/1981 | Ferguson et al. | 414/661 |
| 4,299,533 | 11/1981 | Ohnaka | 414/733 |
| 4,619,575 | 10/1986 | Summa et al. | 414/280 |
| 4,932,827 | 6/1990 | Schlunke et al. | 414/280 |
| 5,394,761 | 3/1995 | Diebolt | 74/89.21 |
| 5,692,874 | 12/1997 | Cordani et al. | 414/661 |
| 5,813,816 | 9/1998 | Lloyd et al. | 414/661 |

FOREIGN PATENT DOCUMENTS

| | | |
|---|---|---|
| 0072937 | 3/1983 | European Pat. Off. . |
| 1568365 | 5/1969 | France . |
| 1233557 | 2/1967 | Germany . |
| 1781367 | 12/1970 | Germany . |

*Primary Examiner*—Douglas Hess
*Attorney, Agent, or Firm*—Davis and Bujold

[57] ABSTRACT

The present invention which discloses a device (1) for the transfer of a load (60) from a carrier onto a machine-tool supporting table and vice versa, is simple, inexpensive, very compact and of moderate weight. The transfer device consists of at least one handling arm (2) hinged and connected to the carrier and to the said load. The handling arm (2) is split into a front member (4) and rear member (3) connected by a hinge. The closing and opening movement of the arm (2) is controlled by a jack (11) provided on the rear member (3) and its shaft is secured to a chain (12 intermeshing with two toothed wheels (14, 15) provided on the respective hinges (5,6). The toothed wheels (14, 15) being stationary, the front (4) and rear (3) members of the arm rotate synchronously and in a ratio of 2 in relation to the jack (11), while the free end (7) of the arm follows a substantially rectilinear path parallel to the load transfer plane. The invention is useful in machine-tools, presses and any load transfer equipment.

11 Claims, 3 Drawing Sheets

DEVICE FOR THE TRANSFER OF A LOAD BY THRUST AND TRACTION IN THE SAME PLANE

This invention relates to a device for transferring a load by thrust and traction in the same plane.

BACKGROUND OF THE INVENTION

The present invention relates to a device for transferring a load by thrust and traction in the same plane, called the transfer plane, this device being used in particular to transfer a tool a mold, or a metal mass, from a moving support onto a stationary support, said device being designed to be mounted either on the moving support or on a stationary support, this device comprising at least one hinged handling arm designed to move in the same plane, called the hinge plane, this hinge plane being substantially perpendicular to the load transfer plane, this an comprising at least one front member and one rear member, the rear member being coupled to said support by at least one first hinge, the front member being coupled on the one band to the rear member by at least one second hinge and on the other hand to said load by hooking means provided at its free end, both hinges being located in said hinged arm's hinge plane, this device also comprising driving means designed to move said arm between two end positions, a first folded up position in which tie arm is retracted between the load and the support, and a second fully unfolded position in which the an is extended between the load and the support and reciprocally.

In industry, lift trucks or stackers are commonly used to handle big loads. More specifically, in the field of machine tools or presses used for clicking and forming sheet metal or any other material the tool change is performed by lift trucks which are equipped with a transfer device working by thrust and traction in the same plane. In order to transfer the tool from the lift truck's tray or forks onto the table or the tray of a machine-tool or a press, and reciprocally, known transfer devices making it possible to push and pull the load are installed between the tool and the sliding push plate on the truck's mast. These transfer devices generally comprise a direct double thrust action jack, a multiplier scissors system or chains working by thrust and traction. Nevertheless, these devices all present the drawback of being bulky, particularly in the transfer direction, which moves the load away from said truck's mast. The result of the load being moved away is that its center of gravity is removed in relation to the truck's center of gravity.

The effects of this removal are as follows: it is necessary to oversize the truck's tray and forks, the truck's maneuverability is reduced and the driving wheel's adherence is reduced. It is important to specify that the capacities of a handling device such as a lift truck, are given by the value of the maximum transportable load and the removal of the center of gravity of tie load being transported in relation to the mast's axis. The assembly of the above-mentioned transfer devices therefore presents the drawback of heavily penalizing handling devices' rated capacities, which can be estimated in the region of 25 to 35%.

Some transfer devices have been designed to try and overcome these problems by using a hinged thrust and traction arm in the same plane. In the publication US-A-2 672 249, the arm is comprised of two distinct parts moved by a central jack which drives vertical racks engaging with toothed sectors provided at the corresponding end of both pants of the arm. This drive system is relatively bulky, it is not retractable into the thickness of the mast and requires having two supporting points on either side of the am a first one on the mast side and a second one on the load side. The system for hooking the load at the end of the arm is complex and not very quick to implement. In the publication DE-A-17 81 367, the arm is controlled by a jack, the body of which is securely fixed to the truck, the rod is securely fixed to the front part of the arm and the arm is doubled by additional hinged rods to guide its movements. Despite seeming simpler than the previous one, this drive system presents more or less the same drawbacks.

SUMMARY OF THE INVENTION

The present invention proposes to overcome these drawbacks by providing a compact, light-weight transfer device, the architecture of which allows it to be easily incorporated at the rear of the sliding push plate, i.e. in the thickness of the lift truck's mast. As a result, the lifting device's capacities are in no way affected. What is more, this transfer device presents a simple design and structure. Furthermore, it represents a small investment and can be installed on any handling device or directly onto a machine-tool. In addition, the path of this transfer device remains stable during a transfer operation and does not require any external guiding, or any additional support.

The aim is achieved by a transfer device as disclosed in the preamble and characterized in that the hooking means comprise at least a third hinge provided in the handling arm's said hinge plane, designed to move in a plane parallel to said transfer plane, and in that the means driving means are coupled to said first and second hinges by means of transmission designed to move the handling arm's front and rear members in an angular and synchronous manner.

Preferably, the front and rear members present a substantialy equal length.

In a preferred form of embodiment, the driving means composed at least one double-action jack and the means of transmission comprise at least one chain coupled simultaneously to the two hinges respectively by means of a first and a second toothed wheel.

The jack's casing can be securely fixed to the rear member and, in this case, the jack's rod is securely fixed to the chain, or the jack's rod can be securely fixed to the rear member and, in this case, the jack's casing is securely fixed to the chain. The jack's casing can also be securely fixed to the support and, in this case, the jack's rod is securely fixed to the chain, or vice-versa.

Preferably, the first toothed wheel coupled to the first hinge is securely fixed to said support and the second toothed wheel coupled to the second hinge is securely fixed to the front member.

Furthermore, the first toothed wheel comprises twice as many teeth as the second toothed wheel, so that it moves said front and rear members angularly in a constant ratio which is substantially equal to 2.

The means of transmission can comprise two chains located on either side of the handling arm and, in this case, each hinge is coupled to a pair of toothed wheels located on either side of said hinge.

The hooking means offer the advantage of comprising at least two coaxial journals provided at the end of the handling arm's front member and at least two hooking lugs fixed to said load and designed to receive said journals.

In the case of the moving support being a lift truck provided with a mast, a push plate sliding along this mast and a tray or forks securely fixed to said plate, the transfer device can be advantageously mounted in the mast at the rear of the sliding push plate.

Furthermore, the transfer device can comprise at least two handling arms each associated with their own driving means, these arms being provided on either side of the mast and the means of hooking the load being common and connected to said handling arms.

BRIEF DESCRIPTION OF THE DRAWING

The present invention and its advantages shall become more apparent in the following description of an example of embodiment, with reference to the attached drawings, in which.

DESCRIPTION OF THE PREFERRED EMBODIMENT(S)

Figure 2:
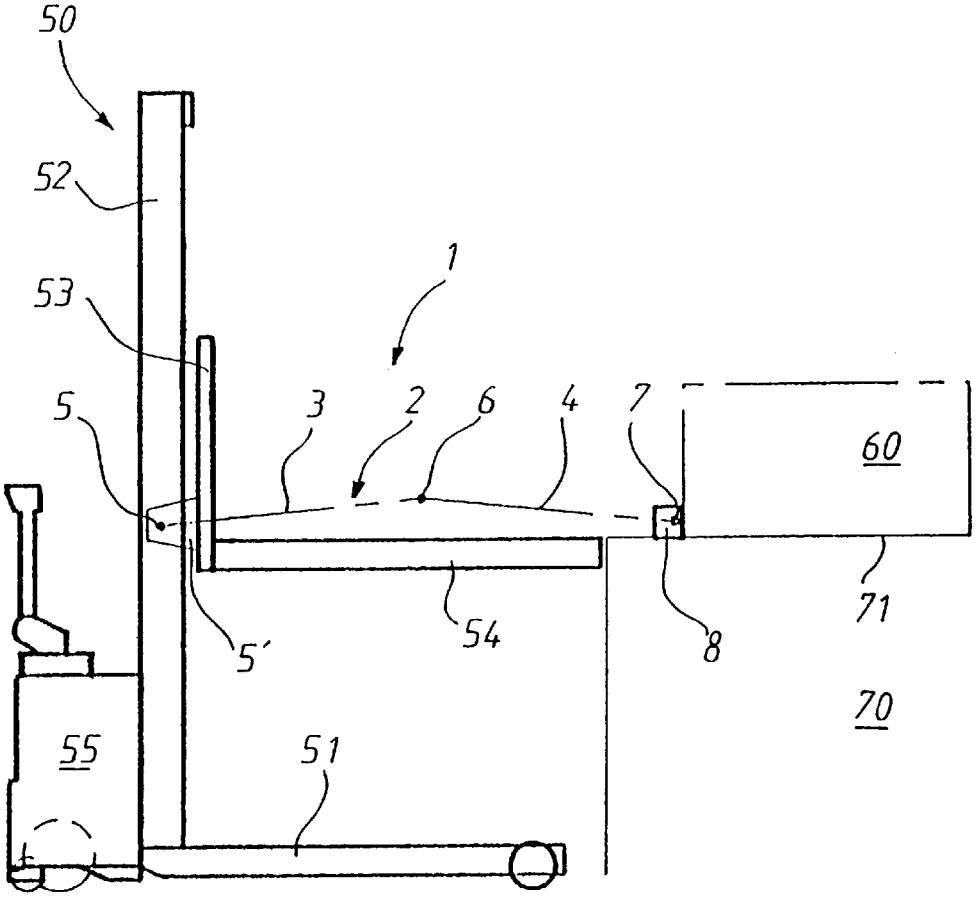
FIG. 2 is a similar view to FIG. 1, the transfer device being in unfolded position and the load being transferred onto a stationary support.
Figure 1:
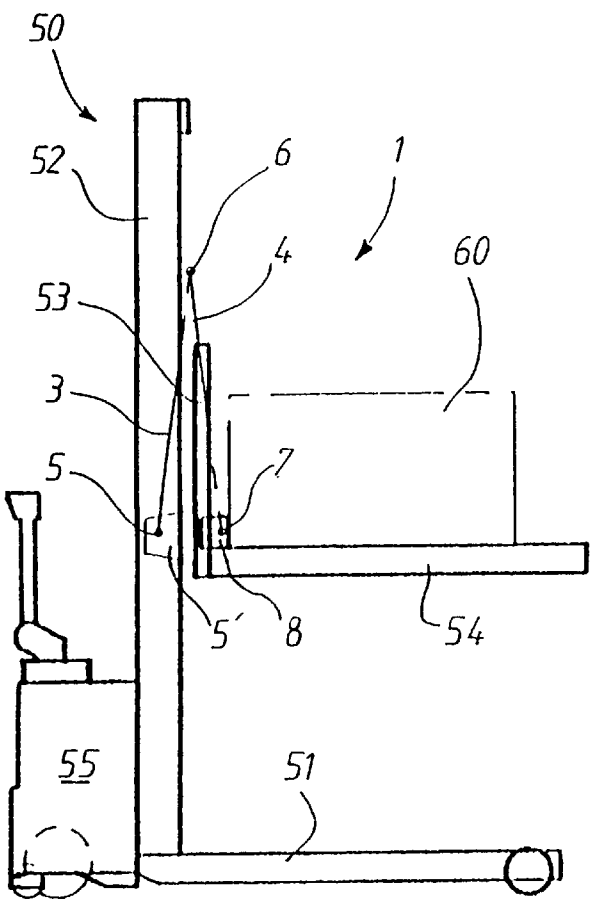
FIG. 1 schematically represents, in a side-face view, a lift truck bearing a load and equipped with a transfer device according to the invention, in folded-up position.

With reference to FIGS. 1 and 2, the transfer device 1 according to the invention is mounted on a moving support, such as a lift truck 50. In a well known manner, the lift truck 50 comprises a traveling chassis 51, a substantially vertical mast 52 securely fixed to chassis 51, a push plate 53 sliding along the mast 52, a horizontal tray or horizontal forks 54 securely fixed to the push plate 53 and a motorization unit 55 for said chassis 51 and said push plate 53. The transfer device 1 provided on this truck is designed to transfer, in the same plane, subsequently called the transfer plane, a load 60 carried by the tray or the forks 54 of the lift truck 50 onto a stationary support, such as a machine-tool or a press 70 and vice-versa. The transfer plane is defined by a table 71 of the machine-tool 70 extending from which are positioned the tray and the forks 54 of the lift truck 50. In order to ensure the stability of the plane during the transfer of the load 60, the end of the tray or the forks 54 is provided with a edge designed to rest on the table 71 of the machine-tool 70.

Figure 4A:
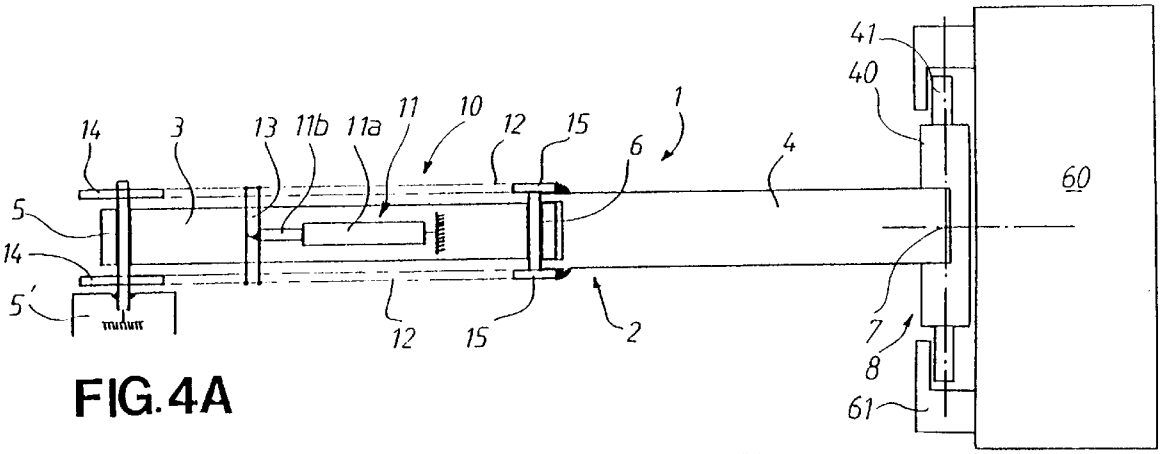
FIG. 4A is a topview of the transfer device in FIG. 3.
Figure 4B:
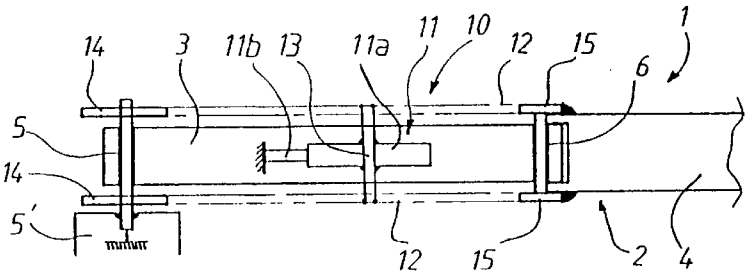
FIG. 4B is a partial view similar to that in FIG. 4A of an alternative embodiment of the transfer device according to the invention, and FIGS. 5A, 5B and 5C schematically represent, in a cutaway view and topview, three examples of assembly of the transfer device according to the invention on a lift truck.
Figure 3:
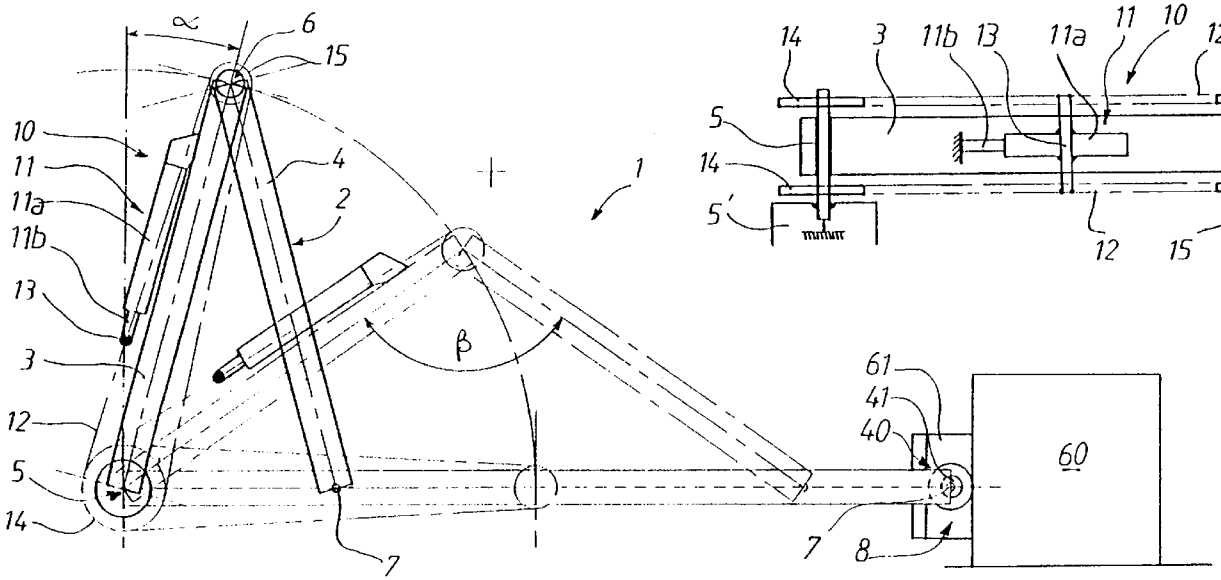
FIG. 3 is a side-face view of the transfer device according to the invention, shown in three successive positions.

With reference as well to FIGS. 3, 4A and 4B, the transfer device 1 comprises a hinged handling arm 2 in the same plane, subsequently called hinge plane, this arm being split into a rear member 3 and a front member 4. The rear member 3 is coupled to the lift truck 50, and in particular to the sliding push plate 53, by a first hinge 5 provided on a support 5' which is securely fixed to said push plate. The front member 4 is coupled to the rear member 3 by a second hinge 6. The free end 7 of the front member 4 is coupled to said load 60 by automatic or manual hooking means 8 constituting a third hinge 40 which moves in a plane parallel to the transfer plane. The three hinges 5, 6 and 40 are arranged in the handling arm's said hinge plane. This third hinge 40 is made up of two coaxial journals 41 provided on either side of the T-shaped end 7 of the front member 4. These journals 41 can be fixed or retractable in said end 7. In the case of fixed journals 41, the load 60 is provided with hooking parts 61 in the shape of an upwardly and downwardly open angle fixed to said load 60 by screws or other appropriate fastening means. The job of hooking or unhooking the arm from the load 60 is performed easily when lowering or raising the lift truck's 50 push plate 53. This movement from top to bottom and vice-versa makes it possible for the journals 41 to either enter or leave the hooking angles 61. In the case of retractable journals 41 in the end 7 of the handling arm 2, the hooking parts 61 provided on the load can comprise for example inclined access ramps to automatically retract the journals in the end 7 when hooking and/or unhooking, and internal housings to receive said journals in the out position making it possible to lock the hooking of the load 60.

It is clear on these Figures that the handling arm 2 is designed to move between end positions, a first folded-up position in which it is put away and merges with the structure of the mast 52 and the sliding push plate 53 of said lift truck 50 and a second unfolded position in which it is extended between said mast 52 and the load 60 transferred or to be transferred. This handling arm 2 is specially designed so that its free end 7 can move, on its own, without a guide device, without a supporting point, following a substantially rectilinear path lying in a plane which is substantially parallel to the load's transfer plane, from one end position to another and vice-versa. In the example shown, the handling arm's hinge plane is substantially perpendicular to the load's transfer plane.

The handling arm's 2 end positions are shown by FIG. 3 by a thick line for said first position, by a thin line for said second position and by short dotted lines for an intermediate position. This handling arm 2 is associated with driving means 10 comprising a hydraulic, pneumatic or electric double-action jack 11. This jack 11 can be provided on the rear member 3, as show by FIGS. 3 and 4A, but can also be provided directly on the lift truck's 50 structure or on another fixed supporting point separate from said handling arm 2 In FIG. 4A, the casing 11*a* of the jack 11 is securely fixed to the rear member 3 and the rod 11*b* of this jack 11, is made securely fixed to two parallel transmission chains 12, by means of a coupling bar 13. Conversely, in FIG. 4B, the rod 11*b* of the jack 11 is securely fixed to the rear member 3 and the casing 11*a* of the jack 11 is made securely fixed to the transmission chains 12 by the coupling bar 13. Each chain 12 is designed to engage simultaneously in a first toothed wheel 14 provided on the first hinge 5 and in a second toothed wheel 15 provided on the second hinge. The first toothed wheels 14 are fixed rigidly onto the mast 52 of the lift truck 50 whilst the second toothed wheels 15 are fixed rigidly onto tide front member 4 of said handling arm. Said first toothed wheels 14 present twice as many teeth as the second toothed wheels 15.

This special arrangement of the driving means 10 makes it possible to ensure the angular and simultaneous displacement of the front member 4 and rear member 3 of the handling arm 2 by means of one single jack. When the jack's 11 rod comes out, the transmission chains 12 are driven simultaneously by the coupling bar 13 in a rectilinear displacement. As the first toothed wheels 14 are stationary, the rectilinear displacement of the chains 12 in collaboration with the jack's 11 fixed supporting point creates a relative displacement of an angle $\alpha$ of said rear member 3, the axis of the second hinge 6 describing an arc of a circle the center of which corresponds to the axis of the first hinge 5. The rectilinear displacement of the chains 12 in collaboration with the jack's 11 fixed supporting point simultaneously creates a relative displacement of an angle $\beta$ of said rear member 3, in the opposite direction to the rear member 3, the free end 7 being displaced along a straight line parallel to said load transfer plane. The first and second toothed wheels 14, 15 having a constant ratio of 2, the front member 4 and rear member 3 of said handling arm move in the same ratio. As a result, the angle β corresponding to the opening between the two front member 4 and rear member 3 is equal to twice the angle α corresponding to the clearance of the rear member 3 in relation to a substantially vertical axis passing through the first hinge 5. Due to this constant ratio of 2, the path of the free end 7 of the handling arm 1 is substantially rectilinear.

In the example shown, the lengths of the front member 4 and rear member 3 of the handling arm 2 are substantially equal. It is obvious that this characteristic is not obligatory in the same way as the constant ratio of 2 existing between the toothed wheels 14, 15. The lengths of the front member 4 and rear member 3 can be different without for all that calling into question the operation of the handling arm 2. The handling arm 2 as shown in FIGS. 1 to 4 corresponds to an optimum embodiment. The thrust force which it exerts at its free end 7 on the load 60 is directly proportional to the ratio of the torque applied on the hinges 5, 6 over the height of the arm. The more the arm unfolds, the more the arm lowers and the greater the thrust force becomes. When starting, this force is at its minimum as the arm is at its highest point. It is then advisable to size the toothed wheels, the chains, the jack as well as its supply pressure accordingly, so that this minimum force is sufficient to move said load 60. The chains can comprise one or more rows. With the aim of facilitating the transfer of the load 60, whilst in particular limiting the thrust or traction stresses required, the tray and forks 54 of the lift truck 50 are generally provided with rows of balls or bearings arranged in the direction of the transfer. While the load 60 is being transported these balls or bearings (not shown) can be retracted into the thickness of the tray or forks 54. Futhermnore, due to the configuration of the hooking means 8, the operation involving the hooking or unhooking of the arm 2 in relation to the load 60 is performed simultaneously when taking up or deposing said load. The simultaneous combination of these functions is only made possible due to the considerable vertical rigidity of the handling arm 2 obtained by the presence of two transmission chains 12.

Figure 5C:
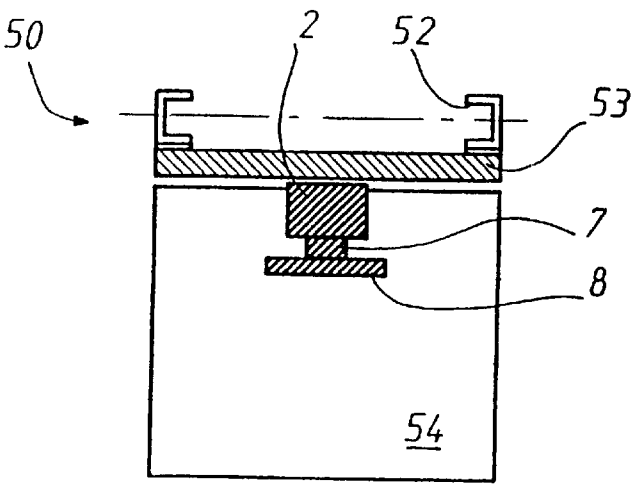
Figure 5B:
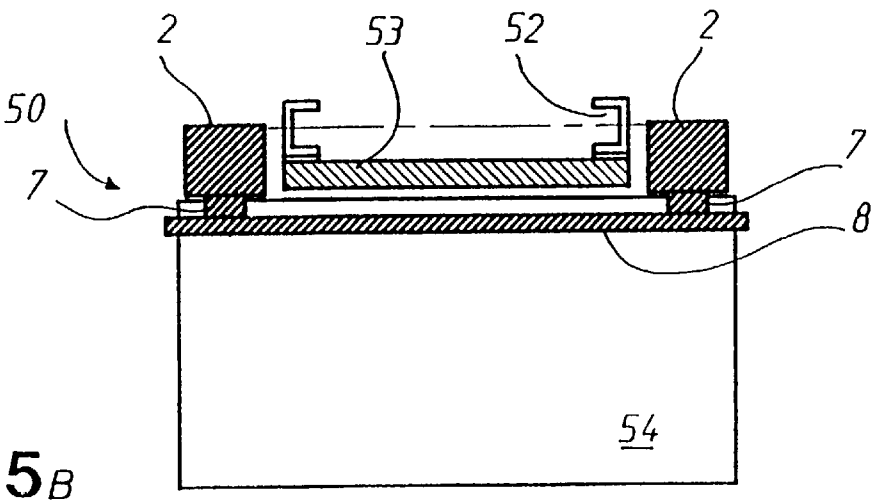
Figure 5A:
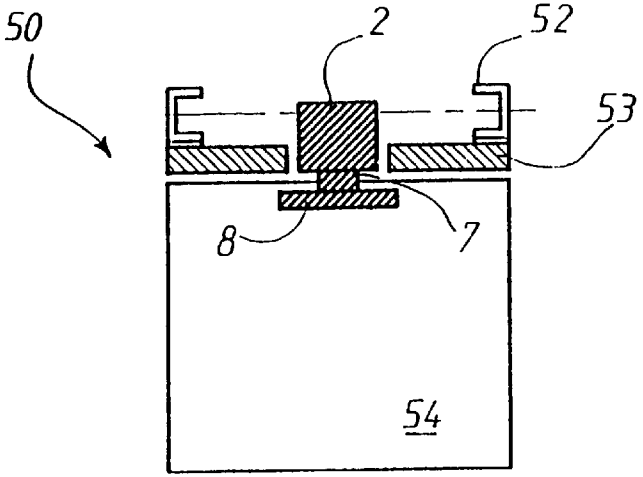

FIGS. 5A to SC show various possibilities for implementing said transfer device 1 according to tile invention. In FIG. 5A, the handling arm 2 is part of the structure of the lift truck, particularly at the rear of the push plate 53 and between the structural sections of the mast 52, like in FIGS. 1 and 2. In this case, only the free end 7 equipped with the hooking means 8 projects from the push plate 53. In FIG. 5B, the transfer device is doubled by two handling arms 2 provided on either side of the mast 52 at the rear of the push plate 53. This construction can be envisaged for very heavy loads. In this case, the free ends 7 are coupled to common hooking means 8 to ensure a regular displacement of the load. The two handling arms 2 are combined with their own driving means which can be jointly controlled to ensure synchronous displacement. In FIG. C, the handling arm 2 is mounted on an existing lift truck 50, at the front of the push plate 53. Even in this configuration, the transfer device according to the invention is less bulky than known devices such as direct-thrust jacks, scissors or rigid chains.

It clearly emerges from this description that the transfer device according to the invention reaches all the objectives fixed. It is relatively easy to set up, it is possible to imagine mounting it directly on a machine-tool or a press or on any other machine requiring a load transfer. Furthermore, and as FIG. 5B shows, it requires little space and it is possible to consider providing several transfer devices 1 in parallel and to couple them using common hooking means in the case of extremely heavy loads.

The present invention is not limited to the examples of embodiment described but can be widened to include any modification or variation which is obvious for the expert. The means of driving 10 the handling arm could comprise an electric motor or any equivalent means. Likewise, the chains 12 and the toothed wheels 14, 15 could be replaced by belts which are synchronous or not and corresponding pulleys or by a series of meshing pinions, or other equivalent means.

What is claimed is:

1. A device (1) for transferring a load (60) by thrust and traction in a transfer plane, the device being used to transfer one of a tool, a mold, and a metal mass, from a moving support onto a stationary support and vice-versa, said device from a moving support (50) onto a stationary support (70) and vica-versa, said device being mounted on one of said moving support and said stationary support, said device comprising:

at least one hinged handling arm (2) being movable in a hinge plane, the hinge plane extending substantially perpendicular to the load (60) transfer plane, the handling arm (2) comprises at least one front member (4) and one rear member (3), the rear member (3) being coupled to one of the moving support (50) and the stationary support (70) by a first hinge (5), the front member (4) being coupled to the rear member (3) by a second hinge (6) and to the load (60) by hooking means (8) provided at a free end (7), forming a third hinge (40), and the first, the second and the third hinges (5, 6, 40) being arranged in said hinge plane of the handling arm (2); and driving means (10) for moving said arm (2) between a first folded-up position in which the arm is retracted between the load and the support, and a second unfolded position in which the arm is extended between the load and the support, wherein the front member (4) and rear member (3) of the handling arm (2) are of a substantially equal length, the driving means (10) comprises at least one double-action jack (11) integrated with said rear member (3) and combined with means for transmission, the means for transmission comprising at least one chain (12) coupled simultaneously to the first and the second hinges (5, 6), respectively by means of a first (14) and a second (15) toothed wheel, the first toothed wheel (14) is securely fixed to one of the moving support (50) and the stationary support (70) and the second toothed wheel (15) is securely fixed to the front member (4) the first toothed wheel (14) has twice as many teeth as the second toothed wheel (15) so as to move said front member (4) and rear member (3) angularly in a constant ratio which is substantially equal to two; and the third hinge has a linear movement within the hinge plane which is parallel to the transfer plane.

2. The device according to claim 1, wherein a jack's casing is securely fixed to the rear member and a jack's rod is securely fixed to a chain.

3. The device according to claim 1, wherein a jack's rod is securely fixed to said rear member and, a jack's is securely fixed to a chain.

4. The device according to claim 1, wherein the transmission means comprise two chains located on either side of the handling arm and a pair of toothed wheels located on either side of said first hinge and second hinge.

5. The device according to claim 1, wherein the hooking means comprises at least two coaxial journals provided at the end of the front member, of the handle arm, for coupling with at least two hooking lugs fixed to a load.

6. The device according to claim 1, wherein the moving support is a lift truck (50) provided with a mast (52) slidably supporting a push plate (53) which is slidable along the mast, a tray and forks (54) are securely fixed to a front of said push plate, and the transfer device (1) is mounted in the mast (52) at the rear of a sliding push plate (53).

7. The device according to claim 6, wherein the transfer device comprises at least two handling arms, each of the at least two handling arms has an associated driving means, the at least two handling arms are provided on either side of the mast and the means of hooking the load are the same and connected to said at least two handling arms.

8. A device for transferring a load by thrust and traction in a transfer plane, the device being used to transfer one of a tool, a mold, and a metal mass, from a moving support onto a stationary support and vice-versa, said device being mounted on one of said moving support and said stationary support, said device comprising:

at least one hinged handling arm being movable in a hinge plane, the hinge plane extending substantially perpendicular to the load transfer plane, the handling arm comprises at least one front member and one rear member, the rear member being coupled to one of the moving support and the stationary support by a first hinge, the front member being coupled to the rear member by a second hinge and to the load by hooking means provided at a free end, forming a third hinge, and the first, the second and the third hinges being arranged in said hinge plane of the handling arm; and driving means for moving said arm between a first folded-up position in which the arm is retracted between the load and the support, and a second unfolded position in which the arm is extended between the load and the support, wherein the front member and rear member of the handling arm are of a substantially equal length, the driving means comprises at least one double-action jack integrated with said rear member and combined with means for transmission, the means for transmission comprising at least one chain coupled simultaneously to the first and the second hinges, a first toothed wheel is securely fixed to one of the moving support and the stationary support and a second toothed wheel is securely fixed to the front member, the first toothed wheel has twice as many teeth as the second toothed wheel so as to move said front member and rear member angularly in a constant ratio which is substantially equal to two;

the third hinge has a linear movement within the hinge plane which is parallel to the transfer plane; and the hooking means comprises at least two coaxial journals provided at the end of a front member, of the handle arm, for coupling with at least two hooking lugs fixed to a load.

9. The device according to claim 8, wherein a casing of a jack is securely fixed to the rear member and a rod of a jack is securely fixed to a chain.

10. The device according to claim 8, wherein a rod of a jack is securely fixed to said rear member 3 and a casing of a jack is securely fixed to a chain.

11. The device according to claim 8, wherein the means for transmission comprises two chains located on either side of the handling arm and a pair of toothed wheels located on either side of said first hinge and second hinge.

* * * * *